US008987945B2

(12) United States Patent
Kanayama

(10) Patent No.: US 8,987,945 B2
(45) Date of Patent: Mar. 24, 2015

(54) SWITCH SUPERVISION DEVICE, CONTROL SYSTEM AND CONTROL METHOD

(75) Inventor: Mitsuhiro Kanayama, Takahama (JP)

(73) Assignee: Denso Corporation, Kariya (JP)

( * ) Notice: Subject to any disclaimer, the term of this patent is extended or adjusted under 35 U.S.C. 154(b) by 769 days.

(21) Appl. No.: 13/213,504

(22) Filed: Aug. 19, 2011

(65) Prior Publication Data

US 2012/0078384 A1 Mar. 29, 2012

(30) Foreign Application Priority Data

Sep. 24, 2010 (JP) ..... 2010-214159

(51) Int. Cl.
*G05B 11/01* (2006.01)
*H01H 1/60* (2006.01)

(52) U.S. Cl.
CPC ..... *H01H 1/605* (2013.01)
USPC ..... 307/112; 307/113; 307/116; 307/9.1; 361/3; 361/9; 361/10; 361/103; 361/225; 700/12

(58) Field of Classification Search
USPC ..... 307/112, 113, 116; 361/2, 3, 9, 10, 103, 361/225
See application file for complete search history.

(56) References Cited

U.S. PATENT DOCUMENTS

| | | | | |
|---|---|---|---|---|
| 5,523,633 | A * | 6/1996 | Imaizumi et al. | 307/137 |
| 6,373,311 | B1 * | 4/2002 | Pizzuto et al. | 327/259 |
| 7,362,011 | B2 * | 4/2008 | Komatsu et al. | 307/137 |
| 7,486,088 | B2 * | 2/2009 | Komatsu et al. | 324/700 |
| 7,854,832 | B2 * | 12/2010 | Komatsu et al. | 205/724 |
| 2002/0095494 | A1 * | 7/2002 | Fujita et al. | 709/224 |
| 2005/0231876 | A1 * | 10/2005 | Komatsu et al. | 361/103 |
| 2006/0279893 | A1 * | 12/2006 | Komatsu et al. | 361/103 |
| 2009/0184700 | A1 * | 7/2009 | Kanayama | 323/282 |
| 2009/0189583 | A1 * | 7/2009 | Kawase et al. | 323/282 |
| 2009/0193273 | A1 * | 7/2009 | Kobayashi et al. | 713/320 |
| 2010/0148737 | A1 * | 6/2010 | Li et al. | 323/282 |
| 2010/0295521 | A1 * | 11/2010 | Odaohhara | 323/282 |

FOREIGN PATENT DOCUMENTS

| | | | | |
|---|---|---|---|---|
| JP | 11-296265 | | 10/1999 | |
| JP | 2002063150 | A * | 2/2002 | G06F 15/78 |
| JP | 2003296291 | A * | 10/2003 | G06F 15/78 |
| JP | 2005-160166 | | 6/2005 | |
| JP | 3711849 | | 8/2005 | |
| JP | 2007-112364 | | 5/2007 | |
| JP | 2007-181374 | | 7/2007 | |

* cited by examiner

*Primary Examiner* — Jared Fureman
*Assistant Examiner* — Carlos Laguerre
(74) *Attorney, Agent, or Firm* — Nixon & Vanderhye P.C.

(57) ABSTRACT

A control system has an instruction path of which an object section connects a microcomputer, a switch and a switch supervisory device with one another. The switch sets the path in conductive or non-conductive state on the low side of the microcomputer. An instruction signal is sent to the microcomputer through the conductive path to set the microcomputer in an operation state. When the device judges based on the operation state of the microcomputer that the switch has set the path in a conductive state, the device sends a first signal of first voltage, causing the signal to have current strength equal to or higher than predetermined value in the path, to the object section. When the device judges that the switch has set the path in a non-conductive state, the device sends a second signal of second voltage lower than first voltage to the object section.

10 Claims, 2 Drawing Sheets

SWITCH SUPERVISION DEVICE, CONTROL SYSTEM AND CONTROL METHOD

CROSS-REFERENCE TO RELATED APPLICATION

This application is based upon and claims the benefit of priority of the prior Japanese Patent Application 2010-214159 filed on Sep. 24, 2010, so that the contents of which are incorporated herein by reference.

BACKGROUND OF THE INVENTION

1. Field of the Invention

The present invention relates to a switch supervisory device that is connected with an object section of an instruction path connecting a control unit for controlling a controlled object and a switch for setting the instruction path in a conductive state to send an input signal to the control unit and setting the instruction path in a non-conductive state. Further, the present invention relates to a control system having the control block, the switch and the switch supervisory device. Moreover, the present invention relates to a control method for controlling the control system.

2. Description of Related Art

An electronic control unit mounted on a vehicle has switches and a microcomputer. Each switch opens and closes a signal line through which an instruction is sent. The microcomputer controls a controlled object by sending the instruction through the signal line and each switch. This control unit has been disclosed in Published Japanese Patent Second Publication No. 3,711,849. Some of the switches used in the control unit are undesirably oxidized at contact points so as to lower the switching function. To prevent the deterioration of the switching function, it is required to remove oxidized components from the switches. To remove the oxidized components, it is required to supply electric current, set at a current strength larger than a predetermined value required to remove the oxidized components, to the switches during current-carrying periods. For example, the control unit is additionally provided with a current supply unit to supply a signal having a sufficiently large current to the switches. However, this current supply unit increases the manufacturing cost of the control unit.

Therefore, to prevent the oxidization of the switches, the control unit is generally designed such that a signal produced in an onboard battery set at a high voltage is sent to the switches. More specifically, a section of the signal line connecting the microcomputer with each switch is designed to be pulled up at a battery voltage of the onboard battery when the switch is in the off state. When the switch is turned on, a current path from the onboard battery to the ground through the switch is formed, and a signal produced in the battery is sent to the switch to remove oxidized components of the switch.

However, in this case of sending a signal produced in the onboard battery to each switch, the battery voltage (e.g., 12V) of the onboard battery is higher than the voltage (e.g., 5V) of a power source from which electric power is supplied to the microcomputer. Therefore, when the switch is set in the off state so as to disconnect the signal line from the ground, a signal produced in the onboard battery undesirably goes into the microcomputer through the signal line. Because this signal acts as a dark current, the control unit wastefully consumes electric power of the onboard battery.

To suppress this wasteful electric power, the control unit is, for example, structured so as to send a signal produced in the onboard battery to the signal line every predetermined period of time (i.e., every sending timing) and to check every sending timing whether or not the signal is sent to the microcomputer through the signal line as an input signal. However, in this case, it is required to check the sending of the input signal in synchronization with the sending of the signal produced in the onboard battery. Therefore, a constitutional component (e.g., a timer) for setting the sending timing so as to check the sending of the input signal in synchronization with the sending timing is undesirably required. This element increases the manufacturing cost of the control unit.

SUMMARY OF THE INVENTION

An object of the present invention is to provide, with due consideration to the drawbacks of the conventional electronic control unit, a switch supervisory device, connected with an object section of an instruction path connecting a control unit for controlling a controlled object and a switch for setting the instruction path in a conductive state to send an instruction signal to the control unit and setting the instruction path in a non-conductive state, which suppresses electric power wastefully consumed in the controlled object while reducing the increase of the manufacturing cost of the switch supervisory device.

Another object of the present invention is to provide a control system having the control block, the switch and the switch supervisory device.

A further object of the present invention is to provide a control method for controlling the control system.

According to a first aspect of this invention, the object is achieved by the provision of a switch supervisory device, connected with an object section of an instruction path which connects a control unit for controlling a controlled object with a switch for setting the instruction path in a conductive state on a low side of the control unit to send an instruction signal to the control unit through the instruction path or setting the instruction path in a non-conductive state on the low side of the control unit. The switch supervisory device comprises a path judging block and a signal sending block. The path judging block judges, based on an operation state of the control unit which is structured to be set in a specific operation state in response to reception of the instruction signal, whether or not the switch has set the instruction path in the conductive state. The path judging block is structured so as to judge in response to the specific operation state of the control unit that the switch has set the instruction path in the conductive state. The signal sending block sends a first signal set at a first voltage, causing the first signal to have a first current strength equal to or higher than a predetermined value in the instruction path, to the object section of the instruction path when the path judging block judges that the switch has set the instruction path in the conductive state. The signal sending block sends a second signal, set at a second voltage lower than the first voltage, to the object section of the instruction path when the path judging block judges that the switch has set the instruction path in the non-conductive state.

With this structure of the switch supervisory device, when the switch located in the instruction path is turned on to set the instruction path in the conductive state, the device sends a first signal set at a first voltage to the object section of the instruction path. The first voltage of the first signal causes the first signal to have a first current strength equal to or higher than a predetermined value in the instruction path. The predetermined value of the current strength is required to remove oxidized components from a contact point of the switch.

Because the instruction path is set in the conductive state, the first signal sent to the object section of the instruction path is sent to the switch. Because the first signal has the first current strength sufficient to remove the oxidized components, the oxidized components of the switch can be removed. Accordingly, the deterioration of the function of the switch can be prevented.

In contrast, when the switch is turned off to set the instruction path in the non-conductive state, the device sends a second signal to the object section of the instruction path. The second signal is set at a second voltage lower than the first voltage. Because of the second voltage lower than the first voltage, it can be suppressed that the second signal undesirably goes into the control unit. Accordingly, the switch supervisory device can suppress electric power wastefully consumed in the control unit as a dark current.

Further, assuming that the second signal is sent to the object section of the instruction path every signal setting timing to check whether or not an instruction signal is received in the control unit, it is required to send second signals at equal intervals. Further, it is required to check the sending of the instruction signal in the instruction path in synchronization with each signal setting timing. Therefore, a timing setting element such as a timer is required. However, in this invention, each time the state of the instruction path is changed, the voltage level of the second signal is changed in the object section of the instruction path, and the operation state of the control unit is changed in response to a change in the voltage level of the signal. Therefore, even when no timing setting element is used, the sending of the first signal or the second signal to the object section of the instruction path can be set by detecting the operation state of the control unit. Accordingly, the state of the instruction path can be changed at desired intervals, and the switch supervisory device does not need any timing setting element. That is, the manufacturing cost of the switch supervisory device is not considerably increased.

According to a second aspect of this invention, the object is achieved by the provision of a control system comprising the control unit, the switch and the switch supervisory device.

With this structure of the control system, the switch supervisory device of the control system is operated in the same manner as the operation of the switch supervisory device according to the first aspect of this invention. Accordingly, the control system has the same effects as those obtained in the switch supervisory device according to the first aspect of this invention.

According to a third aspect of this invention, the object is achieved by the provision of a control method in the switch supervisory device, connected with the object section of the instruction path which connects the control unit with the switch, comprising a path judging step, a first signal sending step and a second signal sending step. In the path judging step, the switch supervisory device judges, based on an operation state of the control unit which is structured to be set in a specific operation state in response to reception of the instruction signal, whether or not the switch has set the instruction path in the conductive state. In the first signal sending step, when the switch supervisory device judges in response to the specific operation state set in the control unit that the switch has set the instruction path in the conductive state, the switch supervisory device sends a first signal set at a first voltage, causing the first signal to have a first current strength equal to or higher than a predetermined value in the instruction path, to the object section of the instruction path. In contrast, in the second signal sending step, when the switch supervisory device judges that the switch has set the instruction path in the non-conductive state, the switch supervisory device sends a second signal, set at a second voltage lower than the first voltage, to the object section of the instruction path.

With these steps of the control method, the switch supervisory device is controlled in the same manner as the control of the switch supervisory device according to the first aspect of this invention. Accordingly, the control method has the same effects as those obtained in the switch supervisory device according to the first aspect of this invention.

DETAILED DESCRIPTION OF THE PREFERRED EMBODIMENTS

An embodiment of the present invention will now be described with reference to the accompanying drawings.

Embodiment

Figure 1:
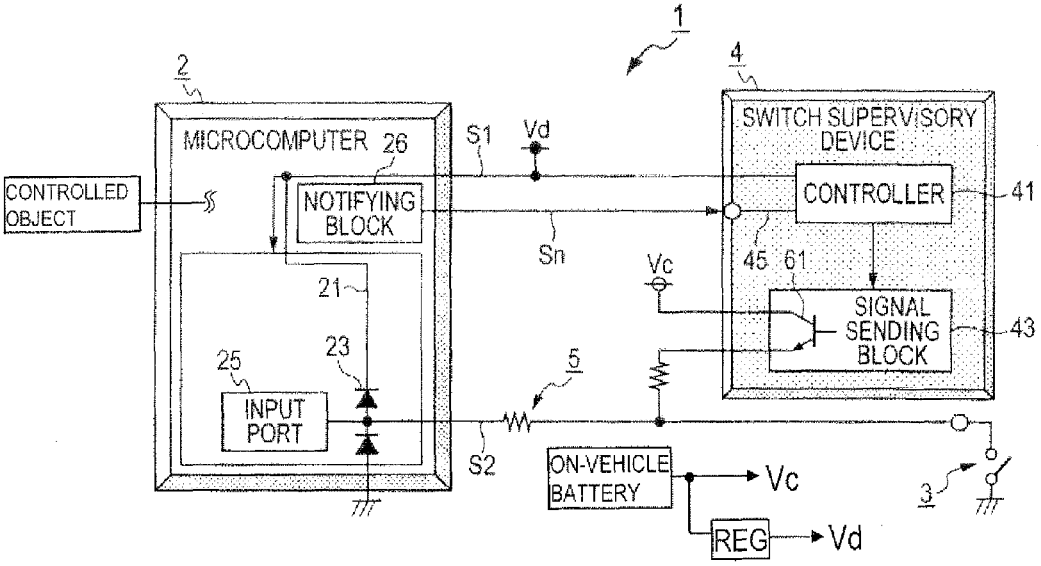
FIG. 1 is a block diagram showing the structure of a control system having a control block, a switch and a switch supervisory device according to an embodiment of the present invention.

FIG. 1 is a block diagram showing the structure of a control system according to this embodiment. As shown in FIG. 1, a control system 1 mounted on a vehicle has a microcomputer (i.e., a control unit) 2 for controlling a controlled object (not shown) to operate the vehicle, a switch 3 that is turned on to set an instruction path (i.e., a signal line) in a conductive state and is turned off to set the instruction path in a non-conductive state, and a switch supervisory device 4 connected with an object section of an instruction path.

The system 1 further has a current-carrying power source Vc, a driving power source Vd and a limiting resistor 5 located in the instruction path to limit the sending of a signal passing through the instruction path. An onboard battery of the vehicle is used as the power source Vc.

The instruction path extends from the driving power source Vd to the ground through the microcomputer 2 and the switch 3. The instruction path has a high side section S1 extending from the driving power source Vd to the microcomputer 2, a low side section S2 extending from the microcomputer 2 to the ground through the switch 3, and an internal section 21 passing through the microcomputer 2 to connect the sections S1 and S2 with each other. The switch 3 is turned on and off on the low side of the microcomputer 2. The section S2 of the instruction path is also called the object section. Therefore, the microcomputer 2 and the switch 3 are connected with each other through the object section of the instruction path. The resistor 5 is located in the section S2 of the instruction path between the microcomputer 2 and the supervisory device 4.

The power source Vc produces a current-carrying signal (i.e., a first signal) set at a current-carrying voltage (i.e., a first voltage) of 12V. The device 4 sends the current-carrying signal to the object section of the instruction path when the switch 3 sets the instruction path in the conductive state. The current-carrying voltage of the current-carrying signal can cause this signal to have a current strength equal to or higher than a predetermined value, required to remove oxidized components from the contact point of the switch 3, in the instruction path.

The power source Vd produces a power source signal (i.e., a second signal) set at a driving voltage (i.e., a second voltage) of 5V sufficiently lower than the current-carrying voltage of the power source Vc and sends this signal to both the microcomputer 2 and the supervisory device 4 as the driving power. Further, the signal produced in the power source Vd is sent to the object section of the instruction path through the microcomputer 2.

The microcomputer 2 has the internal section 21 of the instruction path, a protective diode 23 located in the internal section 21, and an input port 25 connected with the instruction path between the diode 23 and the section S2. The diode 23 clamps the voltage applied to the port 25 at a value equal to or lower than a predetermined value. When the switch 3 is set in the off state to set the instruction path in the non-conductive state, the object section of the instruction path receives the power source signal set at the high level through the internal section 21. The voltage of the power source signal received in the object section of the instruction path is equal to or lower than the driving voltage of the power source Vd. Further, the input port 25 receives the power source signal set at the high level. In this case, the input port 25 holds a first output (i.e., a first signal level) indicating the reception of the power source signal set at the high level. This first output is set at the same level as the level of the power source signal. In contrast, when the switch 3 is set in the on state to set the instruction path in the conductive state, the power source signal produced in the power source Vd is sent to the ground through the internal section 21 and the switch 3. In this case, although the power source signal of the power source Vd sent through the instruction path is a high level, no signal set at a high level is received in the input port 25, but the input port 25 receives a signal set at the low level as an instruction signal. Therefore, the input port 25 holds a second output (i.e., a second signal level) indicating the sending of the instruction signal set at the low level through the instruction path. This second output is set at the same level as the level of the instruction signal. The microcomputer 2 is set in one of operation states such as a waiting state, an operation preparing state and a normal operation state (i.e., a specific operation state). In response to the reception of the instruction signal in the input port 25, the microcomputer 2 is set in the operation preparing state for a short time and is promptly transferred to the normal operation state. When the microcomputer 2 is set in the normal operation state, the microcomputer 2 starts controlling a controlled object according to the instruction signal. Further, in response to the holding of the second signal level in the input port 25, a notifying block 26 of the microcomputer 2 outputs a notifying signal (i.e., a notice) Sn, indicating the sending of the instruction signal through the instruction path, to the supervisory device 4.

The switch supervisory device 4 has a signal receiving path 45 through which the notifying signal Sn sent from the microcomputer 2 is received in the supervisory device 4, a controller (i.e., a path judging block) 41 for controlling the operation of the supervisory device 4 by outputting a current-carrying instruction when the notifying signal is received through the path 45 and outputting an open instruction when no notifying signal is received, and a signal sending block 43 for sending a current-carrying signal to the object section of the instruction path in response to the current-carrying instruction of the controller 41 and stopping to send the current-carrying signal to the object section of the instruction path in response to the open instruction of the controller 41. The sending block 43 has a switching element 61, for example, composed of an n-p-n bipolar transistor. The collector of the transistor is connected with the power source Vc, and the emitter of the transistor is connected with the object section of the instruction path through a resistor. In response to a signal sent to the base of the transistor, a current-carrying signal is sent from the power source Vc to the object section of the instruction path through the transistor, or no signal is sent to the object section.

In this embodiment, the controller 41 is structured so as to have a hardware circuitry for controlling the operation of the supervisory device 4. However, the controller 41 may have a software program stored in a memory to control the operation of the supervisory device 4 according to the program.

The controller 41 judges based on the operation state of the microcomputer 2 whether or not the switch 3 has set the instruction path in the conductive state (in other words, whether the switch 3 is set in the on state). More specifically, when the switch 3 has set the instruction path in the conductive state, the microcomputer 2 receives an instruction signal from the instruction path, and then outputs a notifying signal to the controller 41 through the path 45. In response to the reception of the notifying signal, the controller 41 judges that the switch 3 has set the instruction path in the conductive state. In contrast, when the controller 41 receives no notifying signal, the controller 41 judges that the switch 3 has set the instruction path in the non-conductive state.

During the judgment of the controller 41 that the switch 3 has set the instruction path in the conductive state, the controller 41 continues outputting a current-carrying instruction to the sending block 43 to send a current-carrying signal, set at the battery voltage causing the signal at a current strength higher than the predetermined value, to the object section of the instruction path. In contrast, during the judgment of the controller 41 that the switch 3 has set the instruction path in the non-conductive state (in other words, the switch 3 is tuned off), the controller 41 continues outputting an open instruction to the sending block 43 to send an open signal having a low voltage to the object section of the instruction path.

In response to the current-carrying instruction, the sending block 43 controls the switching element 61 to send a current-carrying signal produced in the power source Vc to the object section of the instruction path. Therefore, because the current-carrying signal is set at a high voltage, electric current of a strength equal to or higher than a certain strength required to remove oxidized components from the surface of the switch 3 is supplied to the turned-on switch 3 during the conductive state of the instruction path.

In response to the open instruction, the sending block 43 controls the switching element 61 to stop sending the current-carrying signal from the power source Vc to the object section of the instruction path. Therefore, because the microcomputer 2 always receives electric power from the power source Vd, electric power of the power source Vd acting as an open signal is sent to the object section of the instruction path through the high side section S1, the internal section 21 and the resistor 5. Therefore, when the controller 41 judges that the switch 3 has set the instruction path in the non-conductive state, the sending block 43 substantially sends the open signal to the object section of the instruction path. Further, the resistor 5 reduces the voltage of the power source signal to the voltage of the open signal, so that the voltage of the open signal sent to the object section is equal to or lower than the voltage of the power source Vd.

Figure 2A:
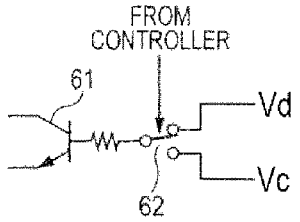
FIG. 2A shows a structure of a signal sending block of the switch supervisory device according to a first modification of this embodiment.

The connection of the power source Vc or Vd with the object section of the instruction path is not limited to this embodiment. For example, as shown in FIG. 2A, the sending block 43 may have a power source changing switch 62. When the sending block 43 receives a current-carrying instruction from the controller 41, this switch 62 is set so as to apply the voltage of the power source Vc to the switching element 61 as a base voltage, and a current-carrying signal set at a high voltage corresponding to the base voltage is sent from the power source Vc to the object section of the instruction path. In contrast, when the sending block 43 receives an open instruction from the controller 41, the switch 62 is set so as to apply the voltage of the power source Vd to the switching element 61 as a base voltage, and an open signal set at a low voltage corresponding to the base voltage is sent from the power source Vc to the object section of the instruction path.

Figure 2B:
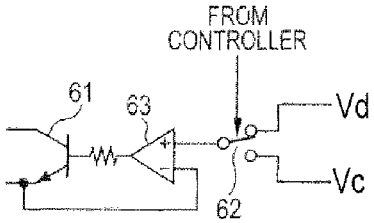
FIG. 2B shows a structure of a signal sending block of the switch supervisory device according to a second modification of this embodiment.

Further, as shown in FIG. 2B, the sending block 43 may have the switch 62 and a comparator 63 having a positive terminal connected with the switch 62 and a negative terminal connected with the emitter of the element 61. The sending block 43 monitors the voltage level of a signal outputted from the element 61, and then performs a feed-back control for the element 61. More specifically, in response to a current-carrying instruction, the voltage of the power source Vc is applied to the positive terminal of the comparator 63 through the switch 62, and the comparator 63 applies a base voltage to the element 61 so as to send a current-carrying signal set at the high voltage of the power source Vc to the object section of the instruction path. In contrast, in response to an open instruction, the voltage of the power source Vd is applied to the positive terminal of the comparator 63 through the switch 62, and the comparator 63 applies a base voltage to the element 61 so as to send an open signal set at the low voltage of the power source Vd to the object section of the instruction path.

Next, an operation of the control system 1 will be described with reference to FIG. 1 and FIG. 3. When the switch 3 is set in the off state (refer to the off state of the switch 3 in FIG. 3), the microcomputer 2 holds a first output at the high level indicating that the input port 25 receives a power source signal from the power source Vd (refer to the high level state of the input port 25 in FIG. 3), and the microcomputer 2 is set in a waiting state (refer to the waiting state of the microcomputer 2 in FIG. 3). Further, during the off state of the switch 3, the signal outputted from the power source Vd is sent to the object section of the instruction path as an open signal (refer to the open signal of the low level sent to the object section in FIG. 3).

Thereafter, when the switch 3 is turned on (refer to the on state of the switch 3 in FIG. 3), an instruction signal having the high voltage of the power source Vc is sent from the supervisory device 4 to the object section of the instruction path and goes to the ground through the switch 3. Therefore, no signal set at a high level is received in the input port 25, and the microcomputer 2 holds a second output at the low level indicating that the input port 25 receives an instruction signal from the supervisory device 4 (refer to the low level state of the input port 25 in FIG. 3). In response to the instruction signal received in the input port 25, the microcomputer 2 starts controlling a controlled object of the vehicle (refer to the preparing and operating states of the microcomputer 2 in FIG. 3).

Figure 3:
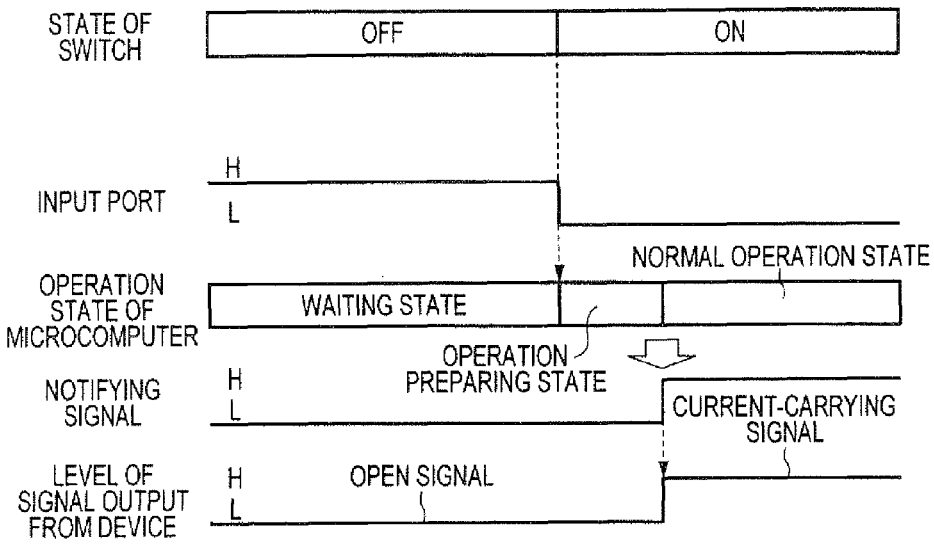
FIG. 3 is a timing chart showing operation states in the control system according to this embodiment.

Then, the microcomputer 2 starting the operation outputs a notifying signal to the supervisory device 4 to notify the supervisory device 4 of the operation start in the microcomputer 2 (refer to the notifying signal set at the high level in FIG. 3). In response to the reception of the notifying signal, the controller 41 outputs a current-carrying instruction to the sending block 43, and the sending block 43 connects the object section of the instruction path with the power source Vc in response to the current-carrying instruction to send a current-carrying signal from the power source Vc to the object section (refer to the current-carrying signal of the high level sent to the object section in FIG. 3).

In this embodiment, the controller 41 indirectly judges based on the operation state of the microcomputer 2 whether or not the switch 3 has set the instruction path in the conductive state. However, the controller 41 may monitor a signal flowing through the low side section S2, the internal section 21 or the high side section S1 of the instruction path. When the switch 3 sets the instruction path in the conductive state, the current or voltage of the signal is changed. Therefore, the controller 41 may directly judge based on a change in the signal that the switch 3 has set the instruction path in the conductive state.

Figure 4:
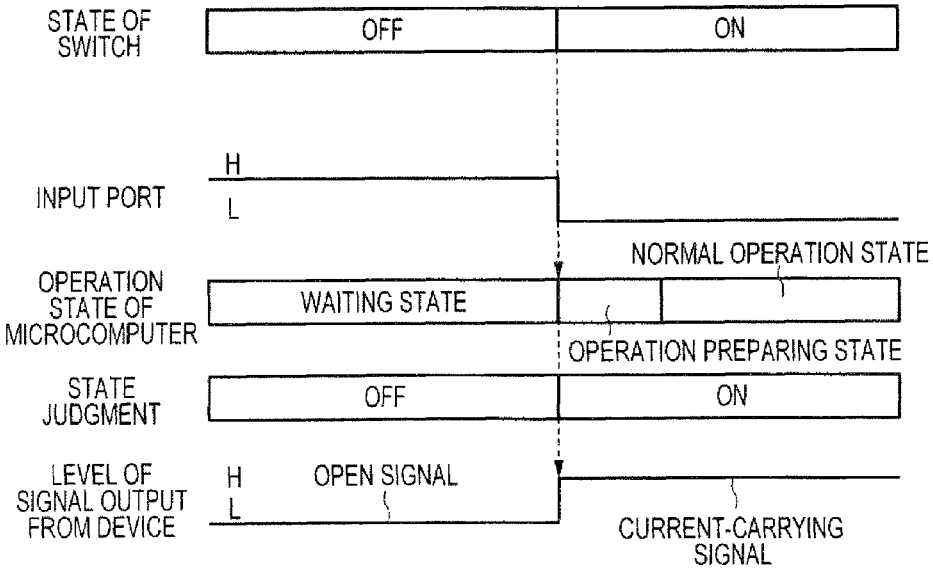
FIG. 4 is a timing chart showing operation states in the control system according to a modification of this embodiment.

In the case where the controller 41 directly judges based on a change in a signal transmitted through the low side section S2 of the instruction path, an operation of the control system 1 will be described with reference to FIG. 1 and FIG. 4. When the switch 3 set in the off state is turned on, (refer to the off state of the switch 3 in FIG. 3), the controller 41 immediately judges, based on a change in a signal transmitted through the low side section S2 of the instruction path, that the switch 3 is set in the on state (see the state judgment in FIG. 4). This judgment is performed without the reception of a notifying signal in the controller 41. Then, the controller 41 outputs a current-carrying instruction to the sending block 43, and the sending block 43 connects the object section of the instruction path with the power source Vc in response to the current-carrying instruction to send a current-carrying signal from the power source Vc to the object section (refer to the current-carrying signal of the high level sent to the object section in FIG. 4).

As described above, when the switch 3 sets the instruction path in the conductive state (in other words, the switch 3 is set in the on state), a current-carrying signal is sent to the switch 3. The voltage of this signal is sufficiently high to send the signal having a current strength equal to or higher than a certain strength required to remove oxidized components from the surface of the switch 3. In contrast, when the switch 3 sets the instruction path in the non-conductive state (in other words, the switch 3 is set in the off state), an instruction signal is sent to the object section of the instruction path. The voltage of the instruction signal is equal to or lower than the voltage of the power source Vd applied to the microcomputer 2.

Therefore, when the instruction path is set in the conductive state, the current-carrying signal is produced in the power source Vc having the voltage (e.g., 12V) sufficiently higher than the voltage (e.g., 5V) of the power source Vd applied to the microcomputer 2, and is sent to the object section of the instruction path to be supplied to the switch 3. This current-carrying signal is set at a high voltage which can cause this signal at the current strength equal to or higher than a predetermined value, required to remove oxidized components from the surface of the switch 3, in the instruction path. Accordingly, the current-carrying signal can appropriately remove oxidized components from the contact point of the switch 3, and the control system 1 can prevent the deterioration of the function of the switch 3.

When the instruction path is set in the non-conductive state, the power source signal sent to the object section of the instruction path is produced in the power source Vd, and the voltage of the power source signal is equal to or lower than the voltage of the power source Vd applied to the microcomputer 2. Therefore, there is no possibility that the power source signal is undesirably sent to the microcomputer 2. Accordingly, the control system 1 can prevent the microcomputer 2 from wastefully consuming electric power of the power source signal as a dark current.

Further, assuming that the power source signal generated in the power source Vd is sent to the object section of the instruction path every signal setting timing to check whether or not an instruction signal is received in the input port 25, it is required to send power source signals at equal intervals. Further, it is required to check the sending of the instruction signal in the instruction path in synchronization with each signal setting timing. Therefore, a timing setting element such as a timer is required. However, in this embodiment, each time the state of the instruction path is changed, the voltage level of the power source signal generated in the power source Vd is changed in the object section of the instruction path, and the operation state of the microcomputer 2 is changed in response to a change in the voltage level of the signal. Therefore, even when no timing setting element is used, the sending of the current-carrying signal or the power source signal to the object section of the instruction path can be set by detecting the operation state of the microcomputer 2. Accordingly, the state of the instruction path can be changed at desired intervals, and the control system 1 does not need any timing setting element. That is, the manufacturing cost of the control system 1 with the switch supervisory device 4 is not considerably increased.

Moreover, in this embodiment, when the microcomputer 2 receives an instruction signal, the microcomputer 2 outputs a notifying signal to the supervisory device 4. Accordingly, the control system 1 can judge whether or not the switch 3 has set the instruction path in the conductive state.

Furthermore, in this embodiment, the low side section S2 of the instruction path extending from the microcomputer 2 to the ground is changed to the conductive state when the switch 3 is turned on. Accordingly, the instruction signal flowing through the instruction path can be sent to the ground through the switch 3.

Still further, in this embodiment, because of the limiting resistor 5 located in the low side section S2 of the instruction path, the sending of a signal can be limited in a section extending from the microcomputer 2 to the supervisory device 4.

Still further, in this embodiment, the protective diode 23 clamps the voltage applied to the port 25 at a value equal to or lower than a predetermined value. Accordingly, the control system 1 can protect the port 25 from a high voltage.

Still further, in this embodiment, when the control system 1 is structured such that the controller 41 directly judges based on a change in a signal transmitted through the low side section S2 of the instruction path that the switch 3 sets the instruction path in the conductive state, the control system 1 can immediately connect the object section of the instruction path and the current-carrying power source Vc, and no structure for outputting the notifying signal is required in the microcomputer 2.

This embodiment should not be construed as limiting the present invention to the structure of this embodiment, and the structure of this invention may be combined with that based on the prier art. For example, in this embodiment, the control system 1 has the fixed instruction path. However, the control system 1 may have a first section of the instruction path and a second section of the instruction path separated from each other in addition to the object section of the instruction path. The first section extends from a battery in which a current-carrying signal set at a sufficiently high voltage is produced so as to have a current strength, being larger than a predetermined value required to remove oxidized components from a contact point of the switch 3, in the instruction path. The second section extends from the driving power source Vd in which a power source signal is produced to be sent to the object section of the instruction path as an open signal. When the switch 3 sets the object section in the conductive state, the first section is connected with the object section to form the instruction path composed of the first section and the object section, and the current-carrying signal is sent to the switch 3 through the object section of the instruction path. In contrast, when the switch 3 sets the object section in the non-conductive state, the second section is connected with the object section to form the instruction path composed of the second section and the object section, and the open signal is sent to the object section of the instruction path.

Further, in this embodiment, the power source signal set at the voltage of 5V is sent to the object section of the instruction path. Therefore, when the switch 3 is turned off, the input port 25 can reliably receive the instruction signal set at a sufficiently low voltage, and the supervisory device 4 can reliably judge that the switch 3 has set the instruction path in the non-conductive state. However, in place of the power source signal produced in the power source Vd, a signal set at a voltage lower than the voltage of the power source Vd may be sent to the object section of the instruction path on condition that the supervisory device 4 can judge whether the state of the instruction path set by the switch 3 is the conductive state or the non-conductive state.

Moreover, the controller 41 judges based on the notifying signal received from the microcomputer 2 that the switch 3 has set the instruction path in the conductive state. However, when the controller 41 detects that the microcomputer 2 actually controls a controlled object according to the instruction signal, the controller 41 may judge that the switch 3 has set the instruction path in the conductive state.

Furthermore, in this embodiment, on condition that the operation state of the microcomputer 2 is changed during the reception of the instruction signal, an alternate type of switch is used as the switch 3. However, in the case where the operation state of the microcomputer 2 is changed in response to the reception of only one pulse or shot of the instruction signal, a momentary type of switch may be used as the switch 3.

Still further, in this embodiment, the control system 1 is structured so as to send the open signal, being equal to or lower than the voltage of the power source Vd applied to the microcomputer 2, to the object section of the instruction path in response to the open instruction received in the sending block 43. However, the control system 1 may be structured so as to send an open signal, having the voltage lower than the voltage of the current-carrying signal outputted in response to the current-carrying instruction, to the object section of the instruction path.

Still further, in this embodiment, the supervisory device 4 performs a path judging step of judging based on the operation state of the microcomputer 2 which is structured to be set in the normal operation state in response to the reception of the instruction signal, whether or not the switch 3 has set the instruction path in the conductive state, a first signal sending step of sending the current-carrying signal set at the high voltage to the object section of the instruction path when the supervisory device 4 judges in response to the specific operation state set in the microcomputer 2 that the switch 3 has set the instruction path in the conductive state, and a second signal sending step of sending the power source signal, set at a voltage lower than the voltage of the current-carrying signal, to the object section of the instruction path as an open signal when the supervisory device 4 judges that the switch 3 has set the instruction path in the non-conductive state. The high voltage of the current-carrying signal causes the current-carrying signal to have a current strength, equal to or higher than a predetermined value required to remove oxidized components from the switch 3, in the instruction path. These steps may be performed by executing a software program in a computer system. The program has many instructions arranged in an order appropriate to the processing of the computer system. These instructions are sent to the supervisory device 4 and the microcomputer 2 through a memory or a communication line. Further, these instructions may be sent to a user's terminal through which the control system 1 is operated.

What is claimed is:

1. A switch supervisory device connected to an instruction path that connects a microcomputer for controlling a controlled object with a switch used to set the instruction path in a conductive state or a non-conductive state, the microcomputer operating in an operation state including a normal operation state and a waiting state, an instruction signal being sent to the microcomputer through the instruction path during the conductive state so as to change the operating state of the microcomputer to the normal operation state from the waiting state, the device comprising:

a path judging block that judges, based on the operation state of the microcomputer, whether or not the switch has set the instruction path in the conductive state, the path judging block being structured so as to judge in response to the operation state of the microcomputer that the switch has set the instruction path in the conductive state; and a signal sending block that sends a first signal set at a first voltage, causing the first signal to have a first current strength equal to or higher than a predetermined value in the instruction path, to the instruction path when the path judging block judges that the switch has set the instruction path in the conductive state, whereby the first voltage is applied to the switch, and sends a second signal, set at a second voltage lower than the first voltage, to the instruction path when the path judging block judges that the switch has set the instruction path in the non-conductive state, whereby the second voltage is applied to the switch.

2. The device according to claim 1, wherein the microcomputer receives a power source signal set at a power source voltage to control the controlled object, and the second voltage of the second signal set by the signal sending block is equal to or lower than the power source voltage when the path judging block judges that the switch has set the instruction path in the non-conductive state.

3. The device according to claim 1, further comprising a signal receiving path through which a notifying signal is sent from the microcomputer to the path judging block in response to reception of the instruction signal in the microcomputer, wherein the path judging block judges in response to reception of the notifying signal that the switch has set the instruction path in the conductive state.

4. A control system, comprising:

a microcomputer for controlling a controlled object, operating in an operation state including a normal operation state and a waiting state;

a switch for setting an instruction path in a conductive state on a low side of the microcomputer to send an instruction signal to the microcomputer through the instruction path or setting the instruction path in a non-conductive state on the low side of the microcomputer, the operating state being changed in response to reception of the instruction signal: and a switch supervisory device, connected with the instruction path which connects the microcomputer with the switch, wherein the switch supervisory device comprises:

a path judging block that judges, based on the operation state of the microcomputer, whether or not the switch has set the instruction path in the conductive state, the path judging block being structured so as to judge in response to the operation state of the microcomputer that the switch has set the instruction path in the conductive state; and a signal sending block that sends a first signal set at a first voltage, causing the first signal to have a first current strength equal to or higher than a predetermined value in the instruction path, to the instruction path when the path judging block judges that the switch has set the instruction path in the conductive state where the first voltage is as a lied to the switch, and sends a second signal, set at a second voltage lower than the first voltage, to the instruction path when the path judging block judges that the switch has set the instruction path in the non-conductive state, whereby the second voltage is applied to the switch.

5. The system according to claim 4, wherein the microcomputer receives a power source signal set at a power source voltage to control the controlled object, and the second voltage of the second signal set by the signal sending block is equal to or lower than the power source voltage when the path judging block judges that the switch has set the instruction path in the non-conductive state.

6. The system according to claim 4, further comprising a power source in which the second signal set at the second voltage is produced, wherein the instruction path has a first section extending from the power source to the microcomputer and a second section extending from the microcomputer to a ground, the switch is disposed in the second section, and the switch sets the second section of the instruction path in the conductive state to send the instruction signal through the instruction path.

7. The system according to claim 4, further comprising a power source in which the second signal set at the second voltage is produced, and a limiting resistor disposed in a section of the instruction path extending from the microcomputer to the switch supervisory device to limit the second signal sent from the power source through the instruction path.

8. The system according to claim 4, wherein the microcomputer comprises:

an input port that holds a signal level, indicating the sending of the instruction signal, when the instruction signal is sent to the microcomputer through a section of the instruction path located in the microcomputer; and a notifying block that outputs a notice, indicating the sending of the instruction signal through the instruction path, when the input port holds the signal level, and the switch supervisory device further comprises a signal receiving path through which the notice outputted from the microcomputer is received, and wherein the path judging block judges in response to the reception of the notice through the signal receiving path that the switch has set the instruction path in the conductive state.

9. The system according to claim 8, wherein the microcomputer further comprises:

a protective diode that clamps a voltage of the signal level, to be held in the input port, at a value equal to or lower than a predetermined value.

10. A control method in a switch supervisory device connected to an instruction path that connects a microcomputer for controlling a controlled object with a switch used to set the instruction path in a conductive state or a non-conductive state, the microcomputer operating in an operation state including a normal operation state and a waiting state, an instruction signal being sent to the microcomputer through the instruction path during the conductive state so as to state of the microcomputer to the normal operation state from the waiting state, comprising:

a path judging step of judging, based on the operation state of the microcomputer, whether or not the switch has set the instruction path in the conductive state;

a first signal sending step of sending a first signal set at a first voltage, causing the first signal to have a first current strength equal to or higher than a predetermined value in the instruction path, to the instruction path when it is judged in response to the operation state of the microcomputer that the switch has set the instruction path in the conductive state, whereby the first voltage is applied to the switch; and a second signal sending step of sending a second signal, set at a second voltage lower than the first voltage, to the instruction path when it is judged that the switch has set the instruction path in the non-conductive state, whereby the second voltage is applied to the switch.

* * * * *

UNITED STATES PATENT AND TRADEMARK OFFICE

CERTIFICATE OF CORRECTION

PATENT NO. : 8,987,945 B2
APPLICATION NO. : 13/213504
DATED : March 24, 2015
INVENTOR(S) : Kanayama It is certified that error appears in the above-identified patent and that said Letters Patent is hereby corrected as shown below:

In the Claims

Beginning at column 12, line 17, should read as follows:

sends a first signal set at a first voltage, causing the first signal to have a first current strength equal to or higher than a predetermined value in the instruction path, to the instruction path when the path judging block judges that the switch has set the instruction path in the conductive state where the first voltage applied to the switch, and Signed and Sealed this
Twenty-fifth Day of August, 2015

Michelle K. Lee

Michelle K. Lee
*Director of the United States Patent and Trademark Office*